US005873456A

United States Patent [19]

Hull et al.

[11] Patent Number: 5,873,456

[45] Date of Patent: Feb. 23, 1999

[54] REMOTE CONTROL DEVICE PROTECTIVE POUCH

[76] Inventors: John R. Hull; Ann M. Hull, both of 4114 Beard, Corpus Christi, Tex. 78413

[21] Appl. No.: 931,194

[22] Filed: Sep. 16, 1997

Related U.S. Application Data

[60] Provisional application No. 60/026,561 Sep. 23, 1996.

[51] Int. Cl. [6] ..... B65D 85/38

[52] U.S. Cl. ..... 206/38.1; 206/305; 206/320; 383/61; 383/86

[58] Field of Search ..... 203/38, 38.1, 305, 203/320; 383/86, 106, 61; 455/128

[56] References Cited

U.S. PATENT DOCUMENTS 4,141,401 2/1979 Hindemit .
4,420,078 12/1983 Belt et al. .
4,762,227 8/1988 Patterson .
4,836,256 6/1989 Meliconi .
4,905,298 2/1990 Walor ..... 383/95
4,951,817 8/1990 Barletta et al. .
5,092,459 3/1992 Uljanie et al. .
5,098,754 3/1992 Horstmyer ..... 383/107
5,265,960 11/1993 Shikler ..... 383/95
5,316,141 5/1994 Jalomo .
5,388,691 2/1995 White .
5,499,713 3/1996 Huffer .

*Primary Examiner*—Jim Foster
*Attorney, Agent, or Firm*—George S. Gray

[57] ABSTRACT

An all-weather protective pouch for remote control devices having pressure sensitive controls, such as the remote control device used with car alarm systems and car automatic locking systems. Primary and secondary waterproofing features are included, along with features allowing the pressure sensitive controls to be seen, accessed, and operated, while the remote control device remains in the pouch.

27 Claims, 8 Drawing Sheets

SECTION "3"–"3"

SECTION "3"–"3"

SECTION "4"–"4"

SECTION "4"–"4"

SECTION "4"–"4"

REMOTE CONTROL DEVICE PROTECTIVE POUCH

REFERENCE TO PROVISIONAL APPLICATION

Reference is herein made to that provisional application for "Remote Control Device Protective Pouch," Ser. No. 60/026,561, filed on Sep. 23, 1996, with regard to which Applicants claim an earlier filing date of Sep. 23, 1996.

BACKGROUND

Our invention relates to the protection of remote control devices from rain and other conditions where the device would otherwise be exposed to water or other liquids. It is particularly suited to remote control devices with pressure sensitive controls.

Although several enclosures, of varying shape, are revealed in the art, none are known to provide protection from actual immersion, heavy rain, and so forth. Furthermore, no such devices appear to be particularly suited to the remote control device which is utilized with respect to car alarm systems and car automatic locking systems.

What is needed is a remote control device cover which closely fits the device and protects it from water while allowing the pressure sensitive controls to be viewed and operated while the device remains in the cover.

SUMMARY OF THE INVENTION

Our invention is a waterproof pouch for a remote control device which allows the operator to view and operate the pressure sensitive controls without removing the remote control device from the pouch. In the preferred embodiment, pouch closure means, first pouch waterproofing means, second pouch waterproofing means, viewing means for viewing a remote control pressure sensitive control through the pouch, operation and access means on the pouch for operating and accessing the remote control pressure sensitive control, and key ring attachment means are provided.

A window opening is present on the front side of the pouch which will allow full visibility, access, and operation of the pressure sensitive controls on a remote control device for car alarm systems and car automatic locking systems. The first pouch waterproofing means comprises the waterproof fabric and waterproof stitching, as well as, a pair of "VELCRO" strips attached to and/or at the interior top portion of the pouch. The strips extend across the entire top opening of the pouch such that the pouch is sealed against water and other liquids when the two strips are pressed together. ["VELCRO" is the trademark for a fastening tape consisting of a strip of nylon with a surface of minute hooks that fastens to a corresponding strip with a surface of uncut pile. Other preferred embodiments use "ZIP-LOC" fasteners or waterproof zippers.]

Second waterproofing means provide additional assurance that the remote control device will be protected from water intrusion. In the preferred embodiment such means comprise a flap and a second pair of "VELCRO" strips positioned on the flap and the exterior of the pouch. The flap bears upon the pouch top when the flap is folded over the pouch top and the second pair of "VELCRO" strips are squeezed together. When so folded the flap itself prevents water intrusion into the pouch. Other preferred embodiments include a number of fasteners to close the pouch rear side flap 46 with the pouch front side top 44, such as a continuously interlocking strip fastener (e.g. "ZIP-LOC") and waterproof zippers.

All figures are enlarged for purposes of clarity. Particular features are substantially proportional.

DESCRIPTION

Figure 1:
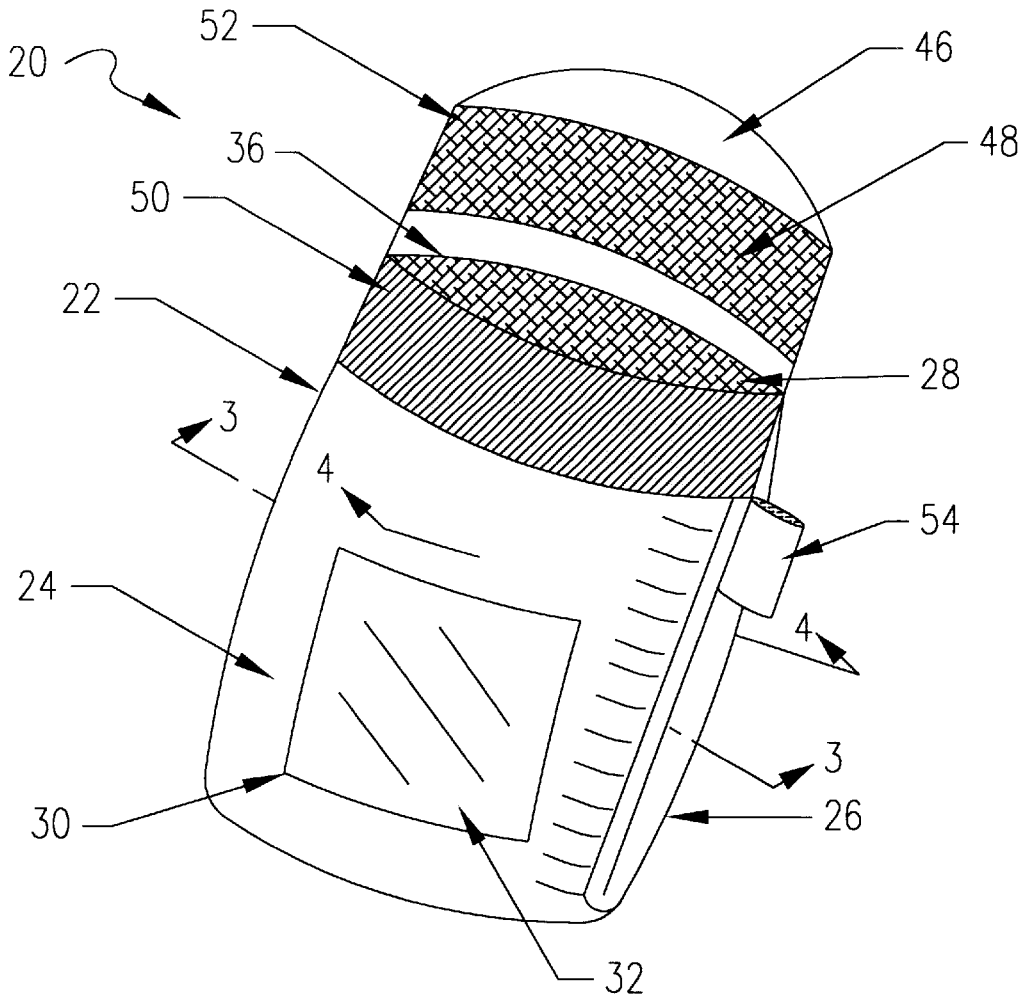
FIG. 1 is an oblique view of the preferred embodiment with the flap open.
Figure 2:
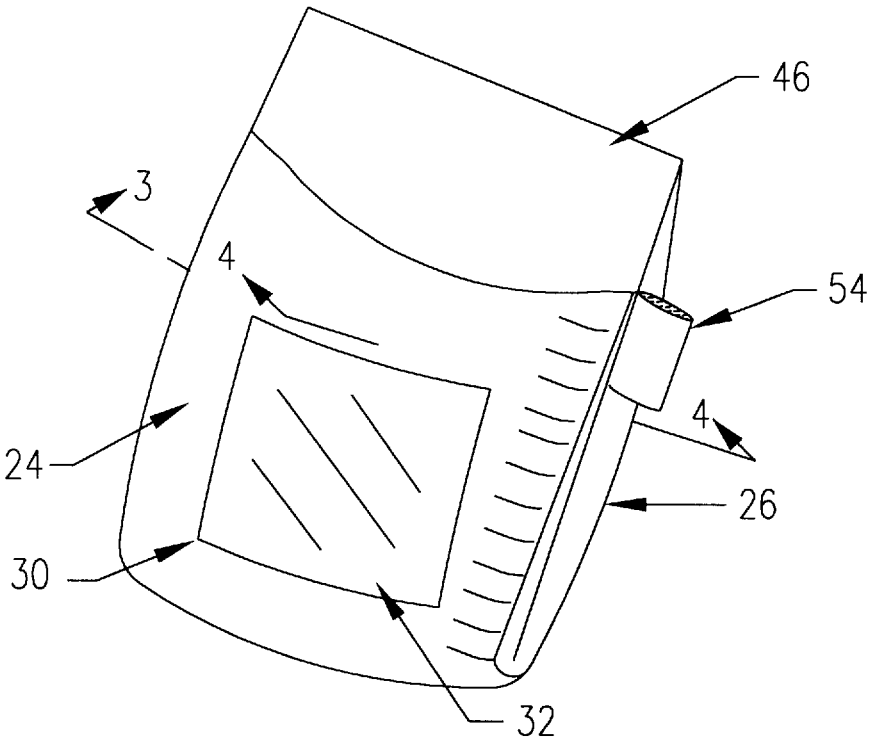
FIG. 2 is an oblique view of the preferred embodiment of the invention with the flap closed.

FIGS. 1–2 depict the preferred embodiment of the device 20 in its open and closed positions, respectively. The pouch 22 is formed by the pouch front side 24 and pouch rear side 26, the two sides being formed by folding and stitching a single piece of fabric. This forms a top opening 28, the top opening 28 and the pouch 22 being shaped and sized to closely receive a remote control device. It is anticipated that various means of forming the pouch may be utilized, including, but not limited to, three sided stitching, one sided stitching, dielectric sealing, heat formed seams, and a seamless pouch.

The pouch front side 24 has remote control device pressure sensitive controls visibility means, which in this preferred embodiment comprise a window opening 30 and a transparent window pane 32. The window opening 30 and window pane 32 are positioned adjacent to pressure sensitive controls on the remote control device. In this position the pressure sensitive controls are visible through the window pane 32. The window pane 32 is shaped and attached to the pouch front side 24 in such a manner that the window opening 30 is completely covered.

Remote control device pressure sensitive controls operation and access means are provided, and in the preferred embodiment comprise the window pane 32 which is sufficiently pliant to allow the operation of the pressure sensitive controls on the remote control unit.

In the preferred embodiment, the pouch 22 size and window pane 32 location are such that the device 20 is particularly suited for a typical remote control device used with car alarm systems and car automatic locking systems. It is anticipated that the all-weather features of our invention will be applicable to pagers, other remote control devices, hand-held calculators, and similar electronic hand-held devices that are frequently used outdoors.

Figure 3A:
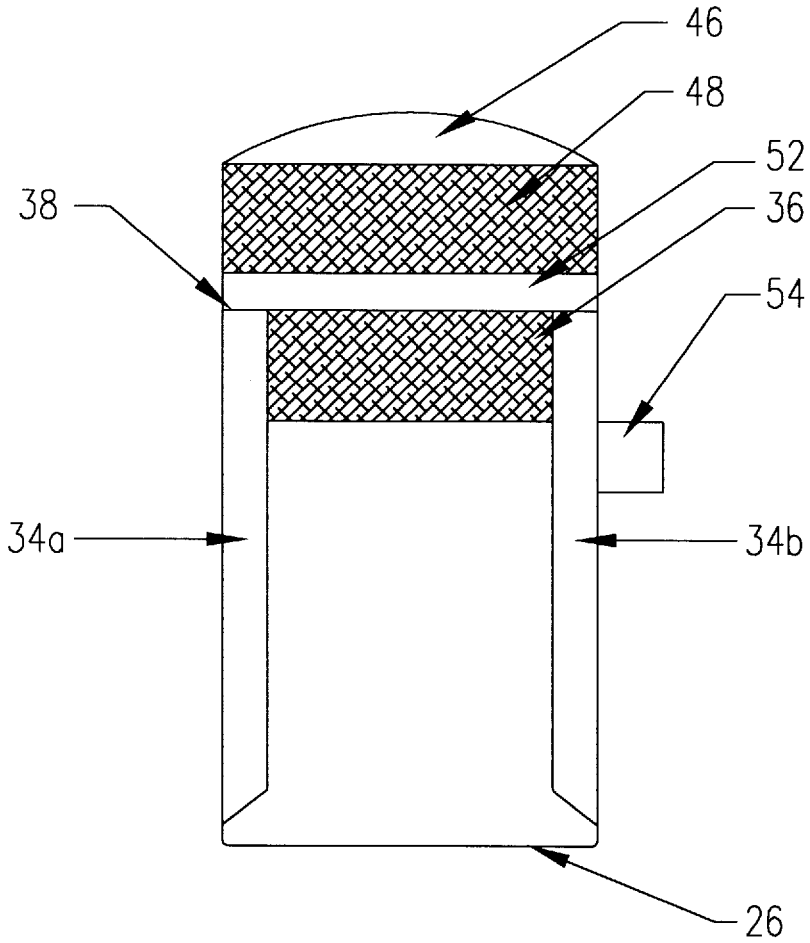
FIG. 3*a* is a sectional view cut along cutting plane 3—3 on FIG. 1, showing the pouch rear side.

FIG. 3*a* depicts the pouch rear side 26 in a sectional view cut along cutting plane 3—3. Pouch rear side stitching folds 34*a–b* are shown, as well as, the pouch rear side interior "VELCRO" strip 36 attached to the pouch rear side top 38.

Figure 3B:
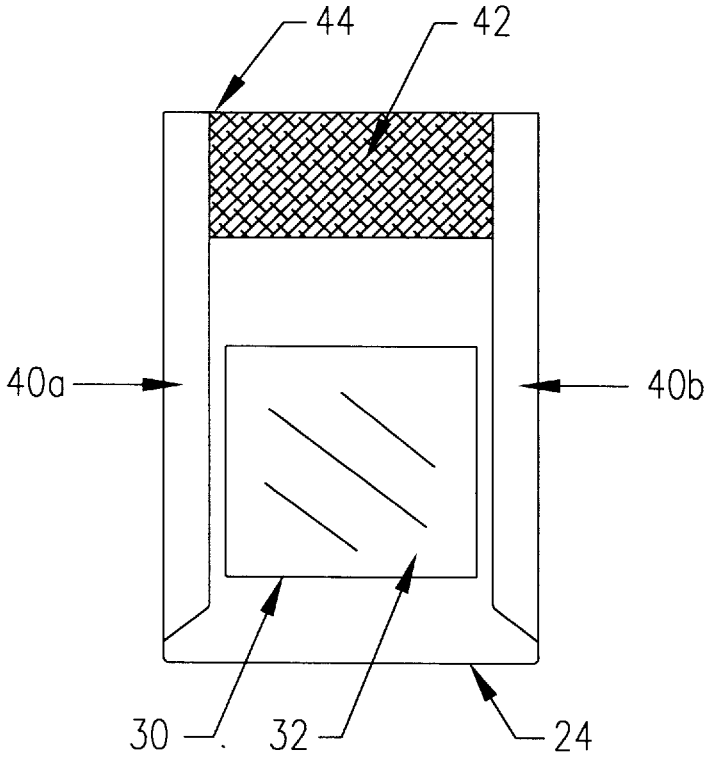
FIG. 3*b* is a sectional view cut along cutting plane 3—3 on FIG. 1, showing the pouch front side, as viewed from the inside of the pouch.

FIG. 3*b* depicts the pouch front side 24 in a sectional view cut along cutting plane 3—3 on FIG. 1, as viewed from the inside of the pouch 22. Pouch front side stitching folds 40*a–b* are depicted which correspond to pouch rear side stitching folds 34*a–b*. Also depicted is the pouch front side interior "VELCRO" strip 42 attached to the pouch front side top 44. The pouch front side interior "VELCRO" strip 42 and pouch rear side interior "VELCRO" strip 36 constitute the preferred embodiment of the pouch 22 closure means by which the pouch 22 is closed.

Figure 4A:
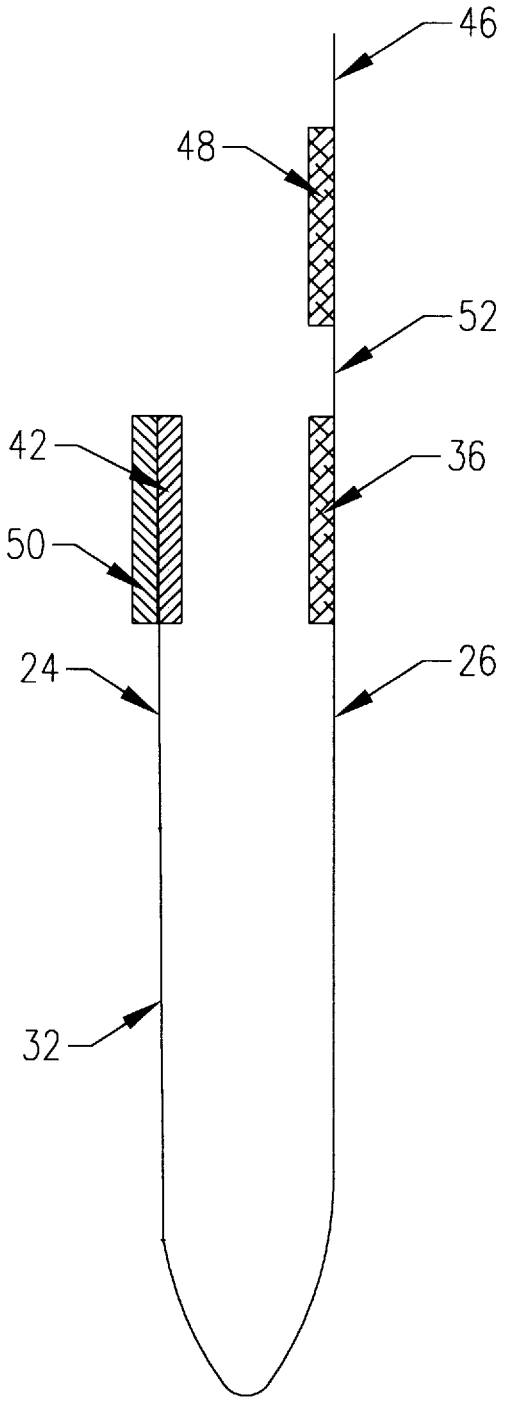
FIG. 4*a* is a sectional view cut along cutting plane 4—4 on FIG. 1, showing the flap open and the pouch top open.
Figure 4B:
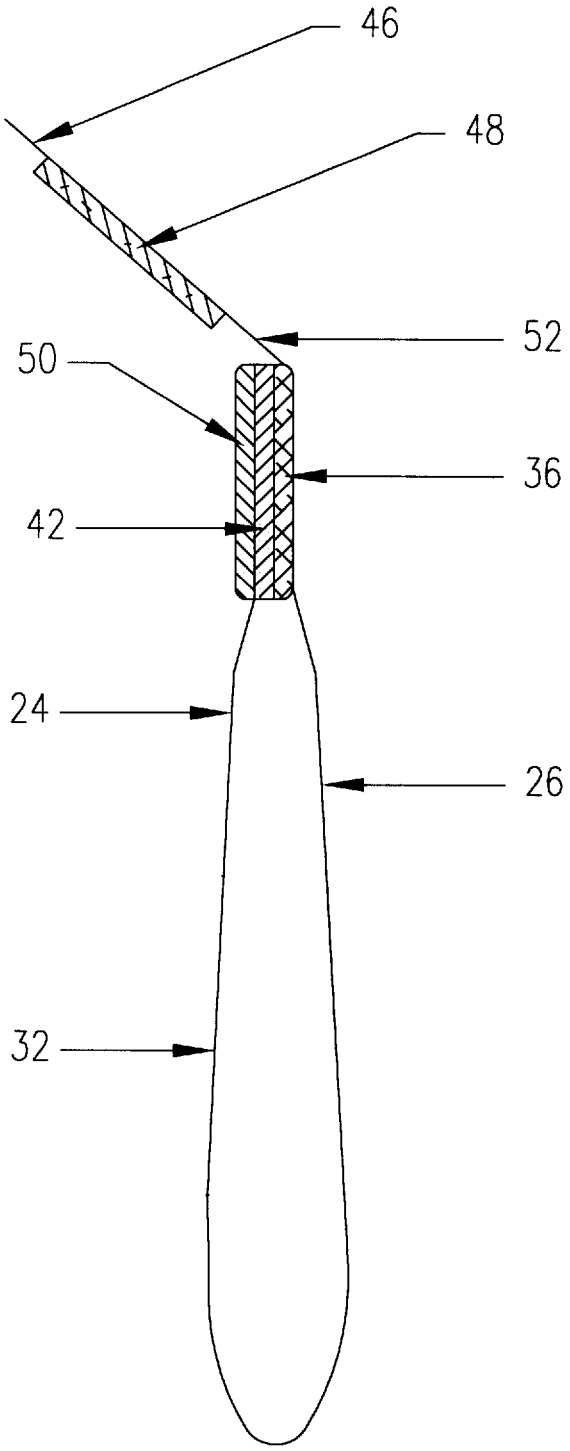
FIG. 4*b* is a sectional view cut along cutting plane 4—4 on FIG. 1, showing the flap open and the pouch top closed.
Figure 4C:
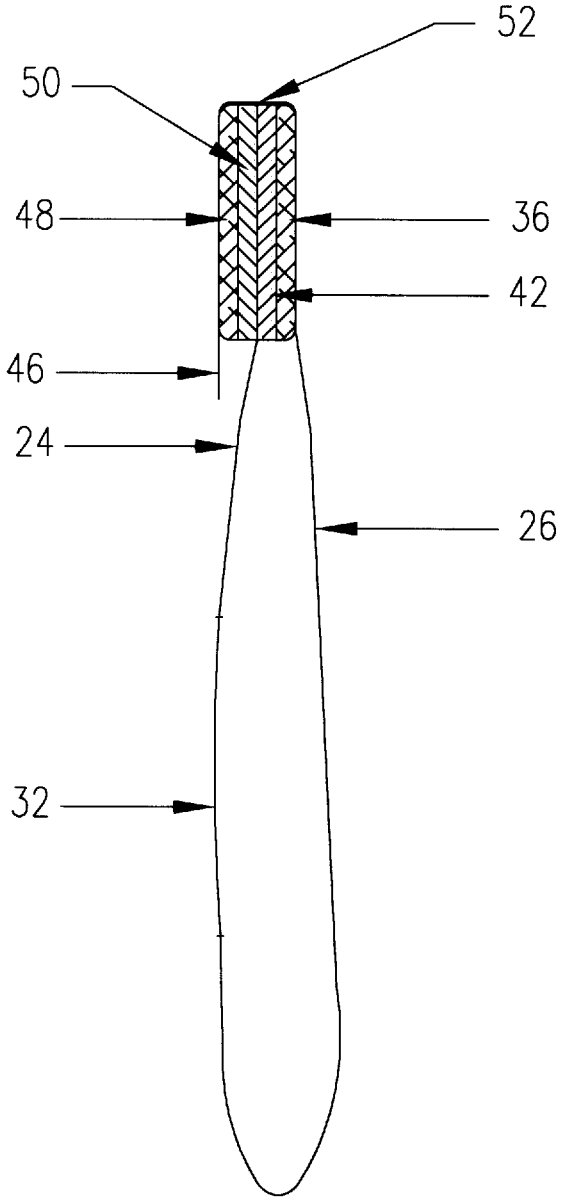
FIG. 4*c* is a sectional view cut along cutting plane 4—4 on FIG. 1, showing the pouch top closed and the flap closed.

First waterproofing means are provided, and in the preferred embodiment comprise waterproof stitching along pouch rear side stitching folds 34*a–b* and pouch front side stitching folds 40*a–b*, waterproof stitching of the window pane 32 in the window opening 30, waterproof material for the entire device 20, and the joinder of the pouch rear side interior "VELCRO" strip 36 with the pouch front side interior "VELCRO" strip 42. This joinder seals the pouch front side top 44 to the pouch rear side top 38. The position of the pouch rear side interior "VELCRO" strip 36 with respect to the pouch front side interior "VELCRO" strip 42, prior to such joinder is depicted in FIG. 4*a*. The actual joinder is depicted in FIGS. 4*b–c*. Experimentation has shown that water intrusion is prevented by such means during immersion of the device 20 in water. It is anticipated that other closure and waterproofing means could be substituted for the "VELCRO" strips, e.g. a waterproof zipper or a a continuously interlocking strip fastener (e.g. "ZIP-LOC").

Second waterproofing means are provided, and in the preferred embodiment, comprise a pouch rear side flap 46 extending upwardly from the pouch rear side 26, a pouch front side exterior "VELCRO" strip 50, and a pouch rear side flap "VELCRO" strip 48. As shown in FIGS. 2 and 4*c* the attachment of the pouch rear side flap "VELCRO" strip 48 leaves an exposed portion of the pouch rear side flap 46. The width of the exposed portion 52 is such that when the pouch rear side flap 46 is folded over the pouch top opening 28 and the pouch front side top 44, the pouch rear side flap 46 exposed portion bears upon and completely covers the pouch top opening 28 and the pouch front side top 44, the pouch rear side flap 46 exposed portion bears upon and completely covers the pouch top opening 28 and the pouch front side top 44. When so folded, the pouch rear side flap "VELCRO" strip 48 is adjacent the pouch front side exterior "VELCRO" strip 50, and when squeezed together results in a complete secondary seal by the pouch rear side flap exposed portion 52. Other preferred embodiments include a number of fasteners, such as a continuously interlocking strip fastener (e.g. "ZIP-LOC") and waterproof zippers.

Figure 5:
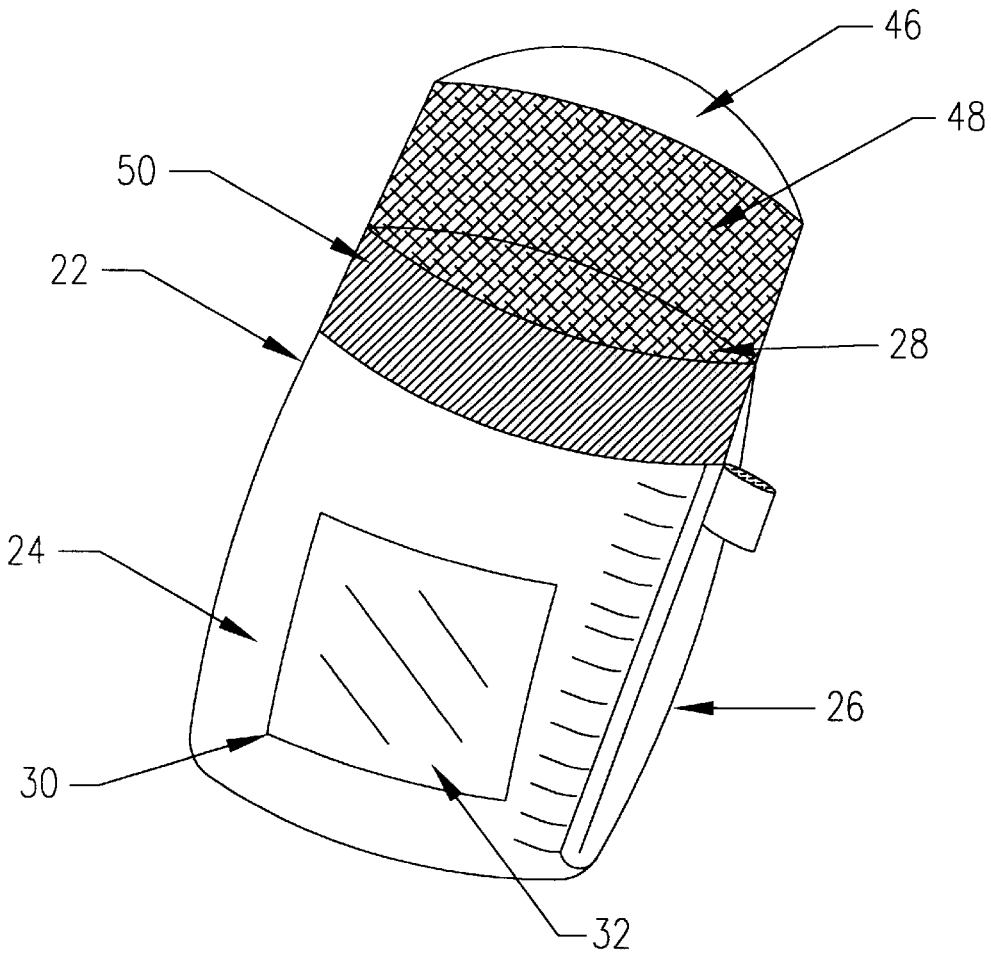
FIG. 5 is oblique view of an alternate embodiment, with the flap open.

Another preferred embodiment of the second waterproofing means is shown in FIG. 5. In this embodiment, the previously described pouch rear side flap "VELCRO" strip 48 is extended to the pouch rear side top 38, eliminating the pouch rear side flap exposed portion 52. When so positioned, the additional "VELCRO" material near the bottom of the pouch rear side top 38 will increase the size of the "VELCRO" contact patch existing between the pouch front side exterior "VELCRO" strip 50 and the pouch rear side flap "VELCRO" strip 48.

Key ring attachments means are provided, and in the preferred embodiment comprise a small loop 54 of material attached to the pouch 22.

Although the present invention has been described in considerable detail with reference to certain preferred and alternate embodiments thereof, other embodiments are possible. Accordingly, the spirit and scope of the claims should not be limited to the description of the embodiments contained herein.

We claim:

1. A device for protecting a remote control device operated by pressure sensitive controls, comprising:

a pouch, the pouch having a front side, a top opening, and a rear side, the pouch front side having a top, the pouch rear side having a top;

pouch closure means for closing the pouch top opening by joining the pouch front side top to the pouch rear side top;

viewing means for viewing a remote control pressure sensitive control through the pouch;

operation and access means on the pouch for operating and accessing the remote control pressure sensitive control;

first pouch waterproofing means; and second pouch waterproofing means.

2. The device of claim 1, wherein the pouch closure means comprises:

a pouch front side interior adherent strip attached to the pouch front side top; and a pouch rear side interior adherent strip attached to the pouch rear side top, the pouch front side interior adherent strip and pouch rear side interior adherent strip being further positioned on the pouch front side top and the pouch rear side top such that the pouch front side interior adherent strip and pouch rear side interior adherent strip may be squeezed together, the pouch front side interior adherent strip and pouch rear side interior adherent strip being reattachable after separation.

3. The device of claim 2, wherein the pouch front side interior adherent strip and the pouch rear side interior adherent strip comprise a hook-and-pile fastening tape combination.

4. The device of claim 2, wherein the pouch front side interior adherent strip and the pouch rear side interior adherent strip comprise a fastener combination which interlocks in a continuous manner along the length of the strip when squeezed such that a seal is formed.

5. The device of claim 1, wherein the pouch closure means comprises a waterproof zipper.

6. The device of claim 1, wherein the viewing means comprises the pouch front side, the pouch front side further having a window opening, the window opening being adjacent the pressure sensitive controls when the remote control device is in the pouch, the viewing means further comprising a transparent window pane, the window pane being attached to the pouch front side such that the window opening is covered.

7. The device of claim 1, wherein the operation and access means comprises the window pane, the window pane being made from a pliant material, such that the pressure sensitive controls can be individually accessed and operated by pressure applied to the window pane adjacent the particular pressure sensitive control.

8. The device of claim 1, wherein the first pouch waterproofing means comprises:

the pouch, the pouch being made of waterproof material;

a pouch waterproof seal joining the pouch front side to the pouch rear side, such that the pouch is sealed from water passage except through the pouch top opening;

a window opening waterproof seal joining the window pane to the pouch front side such that the window opening is sealed from water passage;

the pouch front side interior adherent strip, the pouch front side interior adherent strip being positioned and attached at the pouch front side top such that it extends across the entire pouch front side top; and the pouch rear side interior adherent strip, the pouch rear side interior adherent strip being positioned and attached at the pouch rear side top such that it extends across the entire pouch rear side top, and further such that a seal is formed between the pouch front side top and the pouch rear side top when the pouch front side interior adherent strip and the pouch rear side interior adherent strip are squeezed together, the seal preventing water passage through the pouch top opening.

9. The device of claim 8, wherein the window opening waterproof seal and the pouch waterproof seal each comprise waterproof stitching.

10. The device of claim 8, wherein the pouch front side interior adherent strip and the pouch rear side interior adherent strip comprise a hook-and-pile fastening tape combination.

11. The device of claim 8, wherein the pouch front side interior adherent strip and the pouch rear side interior adherent strip comprise a fastener combination which interlocks in a continuous manner along the length of the strip when squeezed such that a seal is formed.

12. The device of claim 1, wherein the first pouch waterproofing means comprises a waterproof zipper.

13. The device of claim 1, wherein the second pouch waterproofing means comprises:

a pouch rear side flap extending upwardly from the pouch rear side;

a pouch front side exterior adherent strip attached to the pouch front side top, the pouch front side exterior adherent strip extending across the entire pouch front side top; and a pouch rear side flap adherent strip attached to the pouch rear side flap, the pouch rear side flap further having an exposed surface between the pouch rear side top and the pouch rear side flap adherent strip, the pouch rear side flap adherent strip being positioned such that the pouch rear side flap adherent strip is adjacent the pouch front side exterior adherent strip when the pouch rear side flap is folded over the pouch top opening and pouch front side top, the pouch rear side flap adherent strip being further positioned such that the pouch rear side flap exposed surface covers and bears upon the pouch front side top and the pouch rear side top when the pouch rear side flap adherent strip and pouch front side exterior adherent strip are squeezed together, the pouch front side exterior adherent strip and pouch rear side flap adherent strip being reattachable after separation.

14. The device of claim 13, wherein the pouch front side exterior adherent strip and the pouch rear side flap adherent strip comprise a hook-and-pile fastening tape combination.

15. The device of claim 13, wherein the pouch front side interior adherent strip and the pouch rear side interior adherent strip comprise a fastener combination which interlocks in a continuous manner along the length of the strip when squeezed such that a seal is formed.

16. The device of claim 1, wherein the second pouch waterproofing means comprises a waterproof zipper.

17. The device of claim 1, wherein the second pouch waterproofing means comprises:

a pouch rear side flap extending upwardly from the pouch rear side;

a pouch front side exterior adherent strip attached to the pouch front side top, the pouch front side exterior adherent strip extending across the entire pouch front side top; and a pouch rear side flap adherent strip attached to the pouch rear side flap, the pouch rear side flap adherent strip being positioned such that the pouch rear side flap adherent strip is adjacent the pouch front side exterior adherent strip when the pouch rear side flap is folded over the pouch top opening and pouch front side top, the pouch rear side flap adherent strip being further positioned such that the pouch rear side flap covers and bears upon the pouch front side top and the pouch rear side top when the pouch rear side flap adherent strip and pouch front side exterior adherent strip are squeezed together, the pouch front side exterior adherent strip and pouch rear side flap adherent strip being reattachable after separation.

18. The device of claim 17, wherein the pouch front side exterior adherent strip and the pouch rear side flap adherent strip comprise a hook-and-pile fastening tape combination.

19. The device of claim 17, wherein the pouch front side interior adherent strip and the pouch rear side interior adherent strip comprise a fastener combination which interlocks in a continuous manner along the length of the strip when squeezed such that a seal is formed.

20. The device of claim 1, wherein the second pouch waterproofing means comprises:

a pouch front side exterior fastener; and a pouch rear side flap extending upwardly from the pouch rear side, the pouch rear side flap having a pouch rear side flap fastener, the pouch front side exterior fastener being attachable to the pouch rear side flap fastener, the pouch rear side flap further having an exposed surface between the pouch rear side top and the pouch rear side flap fastener, the pouch rear side flap fastener being positioned such that the pouch rear side flap fastener is adjacent the pouch front side exterior fastener when the pouch rear side flap is folded over the pouch top opening and pouch front side top, the pouch rear side flap fastener being further positioned such that the pouch rear side flap exposed surface covers and bears upon the pouch front side top and the pouch rear side top when the pouch rear side flap fastener and pouch front side exterior fastener are attached together, the pouch front side exterior fastener and pouch rear side flap fastener being reattachable after separation.

21. The device of claim 20, wherein the pouch front side exterior fastener and the pouch rear side flap fastener comprise a hook-and-pile fastening tape combination.

22. The device of claim 20, wherein the pouch front side interior fastener and the pouch rear side interior fastener comprise a fastener combination which interlocks in a continuous manner along the length of the strip when squeezed such that a seal is formed.

23. The device of claim 1, wherein the second pouch waterproofing means comprises:

a pouch front side exterior fastener; and a pouch rear side flap extending upwardly from the pouch rear side, the pouch rear side flap having a pouch rear side flap fastener, the pouch front side exterior fastener being attachable to the pouch rear side flap fastener, the pouch rear side flap fastener being positioned such that the pouch rear side flap fastener is adjacent the pouch front side exterior fastener when the pouch rear side flap is folded over the pouch top opening and pouch front side top, the pouch rear side flap fastener being further positioned such that the pouch rear side flap covers and bears upon the pouch front side top and the pouch rear side top when the pouch rear side flap fastener and pouch front side exterior fastener are attached together, the pouch front side exterior fastener and pouch rear side flap fastener being reattachable after separation.

24. The device of claim 23, wherein the pouch front side exterior adherent strip and the pouch rear side flap adherent strip comprise a hook-and-pile fastening tape combination.

25. The device of claim 23, wherein the pouch front side interior adherent strip and the pouch rear side interior adherent strip comprise a fastener combination which interlocks in a continuous manner along the length of the strip when squeezed such that a seal is formed.

26. The device of claim 1, further comprising key attachment means.

27. The device of claim 1, wherein the pouch closure means comprises:

a pouch front side interior adherent strip attached at the pouch front side top; and a pouch rear side interior adherent strip attached at the pouch rear side top, the pouch front side interior adherent strip and pouch rear side interior adherent strip being further positioned on the pouch front side top and pouch rear side top such that the pouch front side interior adherent strip and pouch rear side interior adherent strip may be squeezed together, the pouch front side interior adherent strip and pouch rear side interior adherent strip being reattachable after separation.

* * * * *